US006774851B1

(12) United States Patent
Cuhaci et al.

(10) Patent No.: US 6,774,851 B1
(45) Date of Patent: Aug. 10, 2004

(54) ANTENNA WITH VARIABLE PHASE SHIFT

(75) Inventors: Michel Cuhaci, Ottawa (CA); Jafar Shaker, Ottawa (CA); Mohammad Reza Chaharmir, Ottawa (CA); Abdel Razik Sebak, Brossard (CA)

(73) Assignee: Her Majesty in right of Canada, as represented by the Minister of Industry, Ottawa (CA)

( * ) Notice: Subject to any disclaimer, the term of this patent is extended or adjusted under 35 U.S.C. 154(b) by 0 days.

(21) Appl. No.: 10/256,085

(22) Filed: Sep. 27, 2002

Related U.S. Application Data

(60) Provisional application No. 60/361,291, filed on Mar. 4, 2002, and provisional application No. 60/325,186, filed on Sep. 28, 2001.

(51) Int. Cl.[7] ..... H01Q 1/38
(52) U.S. Cl. ..... 343/700 MS; 343/767
(58) Field of Search ..... 343/767, 746, 343/876, 700 MS, 745, 750, 770

(56) References Cited

U.S. PATENT DOCUMENTS 4,821,041 A * 4/1989 Evans ..... 343/700 MS
6,307,519 B1 * 10/2001 Livingston et al. ..... 343/767

* cited by examiner

*Primary Examiner*—James Clinger
(74) *Attorney, Agent, or Firm*—Freedman & Associates

(57) ABSTRACT

The present invention relates to a reflectarray antenna. The reflectarray antenna comprises a dielectric substrate layer disposed on a ground plane. An array of radiating elements such as microstrip patches of similar size are arranged into a regular lattice configuration on the top surface of the substrate layer. A periodic configuration of slots of variable size are provided at the bottom surface of the substrate layer. A required phase shift at each position on the reflectarray surface is obtained by adjusting the slot length on the ground plane. The incident wave from the feed excites the dominant mode on the microstrip patches The presence of slots acts as an inductive loading of the patches, which introduces a phase shift in the patch response. The inductance of each slot depends on its length. In accordance with an aspect of the invention the phase shift of the individual microstrips is modified by shining an appropriate optical image onto each individual slot element, thereby altering the radiation characteristics of the reflectarray. This approach is highly advantageous for dynamic beam scanning and beam shaping.

47 Claims, 15 Drawing Sheets

ANTENNA WITH VARIABLE PHASE SHIFT

This application claims priority from U.S. Provisional Application Nos. 60/325,186 filed Sep. 28, 2001 and 60/361,291 filed Mar. 04, 2002.

FIELD OF THE INVENTION

This invention relates antennas and in particular to antennas having individual elements that are designed to scatter an incident field with proper phase.

BACKGROUND OF THE INVENTION

With an increasing demand in recent years for worldwide communication systems such as telephone, TV transmission, Internet, to mention a few, the demand for satellite communication is increasing accordingly. Recently, new satellite communication technologies have been developed for multimedia applications. Due to its compact nature the microstrip patch is widely used as the radiating element in reflectarray systems.

A microstrip reflectarray antenna is a low profile structure that comprises a thin, flat conducting backed substrate on which a lattice of patch radiators is etched. A feed antenna illuminates the array of individual elements that are designed to scatter the incident field with the proper phase required to realize a uniform phase front on the antenna aperture. Several different versions of the printed reflectarray structures have been developed and reported previously such as, variable length patches disclosed in: D. M. Pozar, T. A. Metzler, "Analysis of a reflectarray antenna using microstrip patches of variable size", Elect. Letters, Vol.29, April 1993, pp. 657–659, variable stub loaded patches in U.S. Pat. No. 4,684,952 issued to R. W. Munson, August 1987, and variable patch rotation angle in: J. Huang, R. J. Pogorzelski, "A Ka-band Microstrip Reflectarray with Elements Having Variable Rotation Angles," IEEE Trans. Of Antennas Propagat., Vol. 46, No. 5, May 1998 pp 650–656, which are incorporated hereby for reference.

The bandwidth of the reflectarray antenna is limited by phase errors as the signal frequency is shifted away from the design frequency of the antenna.

SUMMARY OF THE INVENTION

It is an object of the invention to complement the prior art by providing an antenna where the required phase shift at each position on the antenna surface is obtained by varying the inductive load of the patches using the slots of varying length sizes beneath the patches.

It is further an object of the invention to provide an antenna where the inductive load of the patches is optically controlled.

The reflectarray antenna according to the invention comprises a dielectric substrate layer disposed on a ground plane. An array of micro-strip patches of similar size are arranged on the top surface of the substrate layer. A periodic configuration of slots of variable size is provided at the bottom surface of the substrate layer. A required phase shift at each position on the reflectarray surface is obtained by adjusting the slot length on the ground plane. The incident wave from the feed excites the dominant mode on the microstrip patches. When there is no slot on the ground plane, each patch radiates the energy at its resonant frequency. The presence of slots acts as an inductive loading of the patches, which introduces a phase shift in the patch response. The inductance of each slot depends on its length.

In accordance with an aspect of the invention the phase shift of the individual micro-strips is modified by shining an appropriate optical image onto each individual element which generates plasma in the exposed regions, thereby altering the radiation characteristics of the reflectarray. This approach is highly advantageous for dynamic beam scanning and beam shaping.

In accordance with the present invention there is provided an antenna comprising:

a dielectric substrate layer having a top surface and a bottom surface, the top surface for providing a radiating array that is other than slot fed;

an array of radiating elements in contact with the top surface forming the radiating array, the radiating elements for radiating one of an emitted and reflected electromagnetic signal; and, a bottom surface layer attached to the bottom surface of the dielectric substrate layer, the bottom surface layer having an array of openings, the openings having a variable dimension for providing a variable inductive loading acting on the radiating elements in order to induce a predetermined phase shift in the radiated electromagnetic signal.

In accordance with the present invention there is further provided an antenna comprising:

a dielectric substrate layer having a top surface and a bottom surface, the top surface for providing a radiating array that is other than slot;

an array of radiating elements in contact with the top surface forming the radiating array, the radiating elements for radiating one of an emitted and reflected electromagnetic signal;

a bottom surface layer attached to the bottom surface of the dielectric substrate layer, the bottom surface layer having an array of openings, the openings having a variable dimension for providing a variable inductive loading acting on the radiating elements in order to induce a predetermined phase shift in the radiated electromagnetic signal; and, a semiconductor substrate layer interposed between the dielectric substrate layer and the bottom surface layer, the semiconductor substrate layer for providing a variable inductive loading acting on the radiating elements through photo-induced plasma effect generated by illumination through the openings of a mask which is set between the optical source and the semiconductor.

In accordance with an aspect of the present invention there is provided a method for controlling a phase shift of an incoming electromagnetic signal in an antenna comprising the steps of:

providing a dielectric substrate layer having a top surface and a bottom surface, the top surface for providing a radiating array that is other than slot;

providing an array of radiating elements in contact with the top surface forming the radiating array, the radiating elements for radiating one of an emitted and reflected electromagnetic signal;

providing a bottom surface layer attached to the bottom surface of the dielectric substrate layer, the bottom surface layer having an array of openings, the openings having a variable dimension for providing a variable inductive loading acting on the radiating elements in order to induce a predetermined phase shift in the radiated electromagnetic signal; and, adjusting the phase shift of the electromagnetic signal by adjusting the phase shift of the radiating elements by varying the dimension of the openings.

In accordance with the aspect of the present invention there is further provided a method for controlling a phase shift in a reflectarray antenna comprising the steps of:

providing a dielectric substrate layer having a top surface and a bottom surface, the top surface for providing a radiating array that is other than slot;

providing an array of radiating elements in contact with the top surface forming the radiating array, the radiating elements for radiating one of an emitted and reflected electromagnetic signal;

providing a bottom surface layer attached to the bottom surface of the dielectric substrate layer, the bottom surface layer having an array of openings, the openings having a variable dimension for providing a variable inductive loading acting on the radiating elements in order to induce a predetermined phase shift in the radiated electromagnetic signal;

providing a semiconductor substrate layer interposed between the dielectric substrate layer and the bottom surface layer, the semiconductor substrate layer for providing a variable inductive loading acting on the radiating elements through photoinduced plasma effect; and, adjusting the phase shift of the radiating elements by illuminating with a predetermined optical intensity the semiconductor substrate through the openings for controllably generating the photo-induced plasma effect.

BRIEF DESCRIPTION OF THE FIGS.

Exemplary embodiments of the invention will now be described in conjunction with the following drawings, in which:

FIGS. 1*a* and 1*b* are simplified diagrams illustrating a perspective view and a cross-sectional view, respectively, of a reflectarray antenna according to the invention;

FIG. 2 schematically illustrates design configurations for determining the reflectarray antenna shown in FIGS. 1*a* and 1*b;*

DETAILED DESCRIPTION OF THE INVENTION

In the following the invention will be described in conjunction with a reflectarray antenna for simplicity. It is understood that the invention is not limited thereto.

A reflectarray antenna comprises an array of elementary radiating elements such as microstrip patches, typically backed by a ground plane. The size, shape, and location of each radiating element are adjusted to realize a desired phase front transformation from the feed phase front to the desired outgoing phase front. Due to its compact nature the microstrip patch is widely used as the radiating element in reflectarray systems.

The main requirement in the design of a microstrip patch reflectarray is to transform the wave front provided from the feed into a desired wavefront, for example a planar wavefront. This is accomplished by appropriate phase adjustment for the individual patches. In the case of a planar wavefront, the required phase shift $\phi_i$ for element i is determined by:

$$\phi_i=2\pi N+k_0(\vec{R}_i-\vec{r}_i.\hat{r}_0 N=0,1,2, \quad (1)$$

where $\vec{R}_i$ is the distance from the phase center of the feed to the $i^{th}$ element, $\vec{r}_i$ is the vector from the center of array to the $i^{th}$ element, and $\hat{r}_0$ is unit vector along the main beam direction.

Figure 1A:
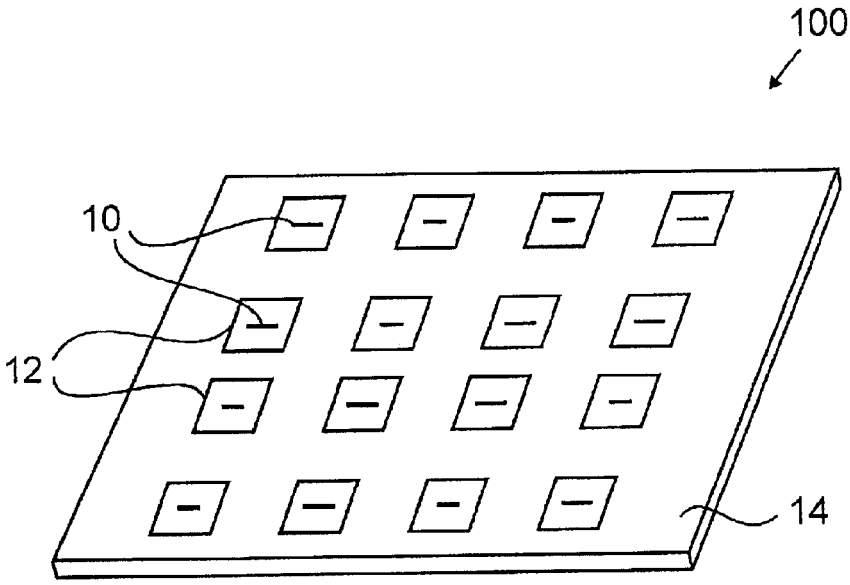
Figure 1B:
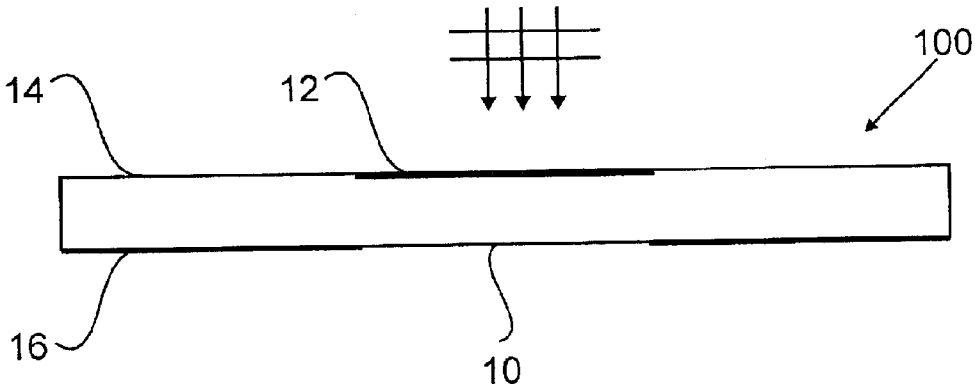

Referring to FIG.1*a* and 1*b,* a perspective and cross-sectional view, respectively, of a reflectarray antenna 100 according to an embodiment of the invention is shown. The antenna 100 comprises a dielectric substrate layer 14 disposed on a ground plane 16. An array of radiating elements 12 in the form of micro-strip patches of similar size are arranged into a regular lattice configuration on the top surface of the substrate layer 14. A periodic configuration of slots 10 of dissimilar length are provided at the bottom surface of the substrate layer 14.

The required phase shift at each position on the reflectarray surface is obtained by adjusting the slot length on the ground plane. The incident wave from the feed excites the dominant mode on the microstrip patches. When there is no slot on the ground plane, each patch radiates the energy at its resonant frequency. The presence of slots 10 acts as an inductive loading of the patches, which introduces a phase shift in the patch response. The inductance of each slot depends on its length.

Optionally, openings of various sizes and shapes are disposed at various locations at the bottom surface. The dimensions of the openings are varied in order to vary the inductive loadings for affecting the phase shift of the radiated electromagnetic signal. Though rectangular slots are a most straightforward slot for design and simulation, slots of arbitrary size and shape are implementable so long as design requirements for the phase adjustment of each patch are achieved.

Figure 2:
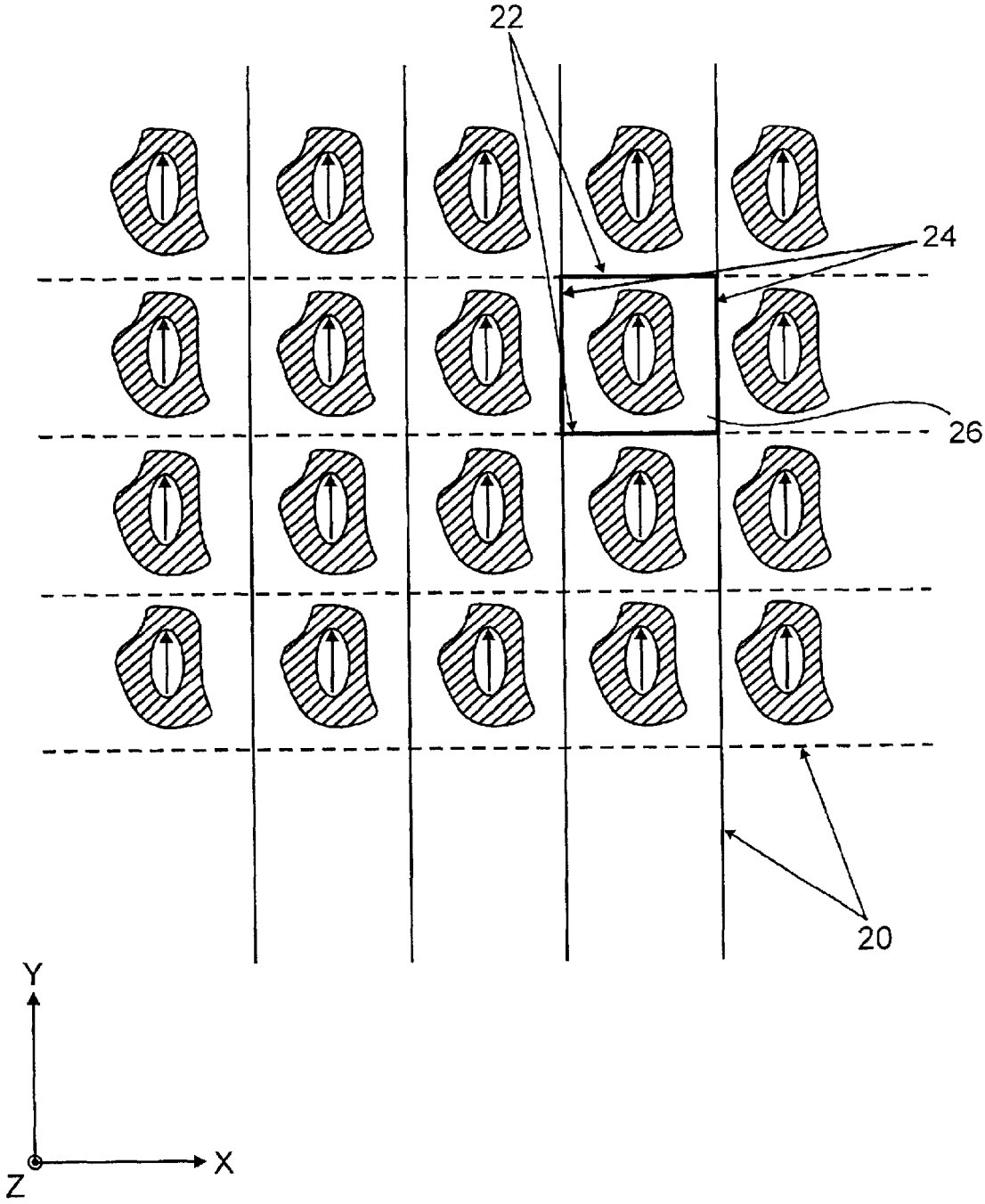

The analysis of the antenna 100 was carried out using Ansoft HFSS software with periodic boundary conditions. An infinite periodic structure has been considered throughout these simulations as shown in FIG. 2. Symmetry planes 22, orthogonal to the E-field, which run horizontally, are replaced with perfect electric walls 22. This is justified by considering that identical currents flowing above and below these planes would result in the cancellation of the tangential electric field. Similarly, vertical symmetry planes, parallel to the E-field are replaced with perfect magnetic walls 24. A plane wave incident from the z-direction with the electric field polarized along the y-axis will induce a current on the unit-cell as described. Therefore, the unit cell 26 is utilized to analyze the structure.

Figure 3:
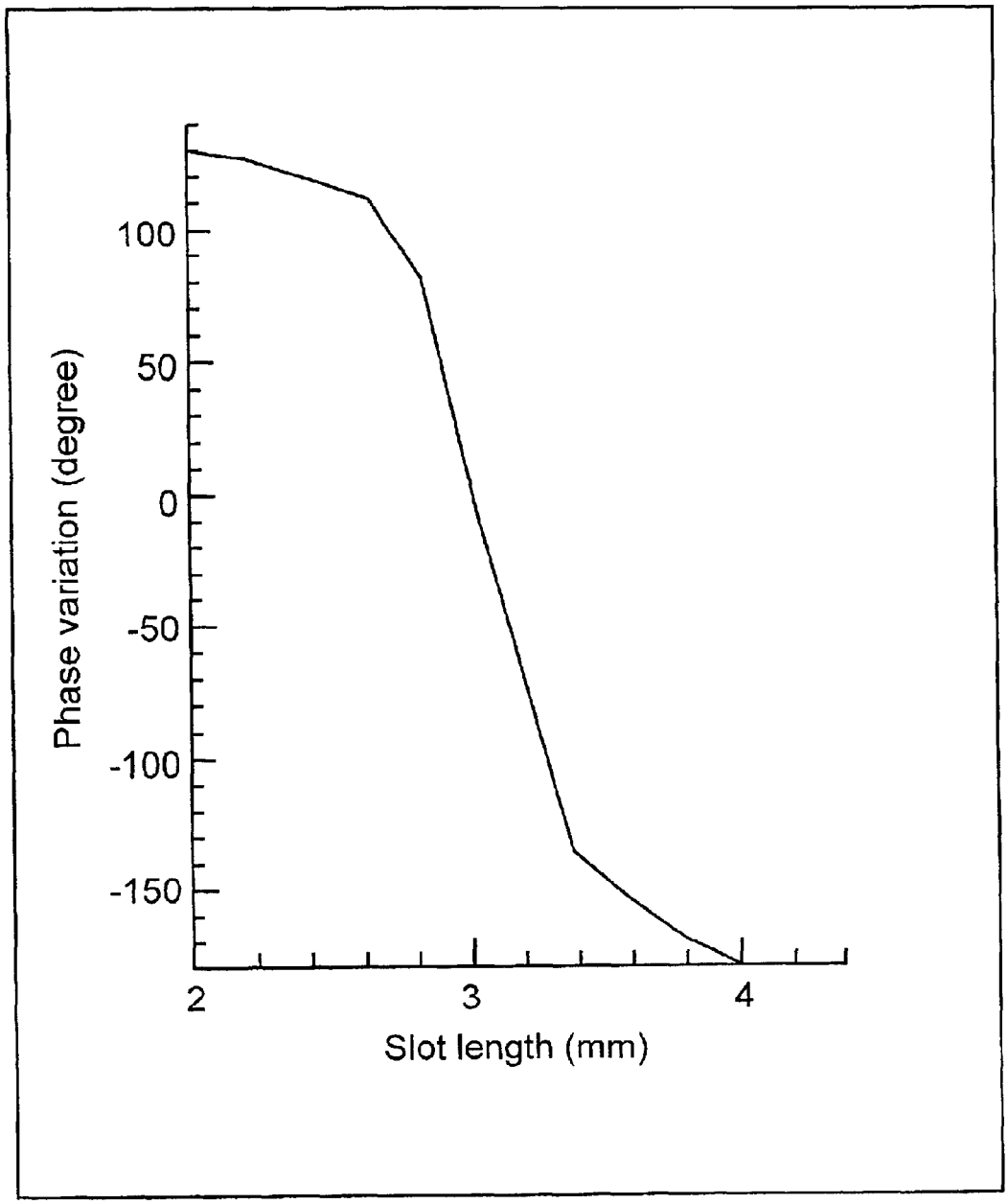
FIG. 3 is a diagram illustrating simulation results of the reflectarray antenna shown in FIGS. 1*a* and 1*b;*

The required phase shift ($\phi$) was realized by adjusting the slot length. A patchslot reflectarray was designed to operate at 26 GHz. The antenna substrate was 0.020" thick with $\epsilon_r$=3.0 (3003 Rogers material). The design comprises 25×25 patches with fixed dimensions of 3.2 mm×2.3 mm, the unit cell size was set at 6 mm×6 mm. The slot width was set at approximately $\lambda/20$—$\lambda$ being the wavelength of the incoming electromagnetic signal—to mitigate the leakage into lower half space and achieve a good phase variation by changing the slot length. The slot width was set at ds=0.2 mm for this example and the antenna was designed for F/D=0.9. To obtain the phase versus slot length variation, infinite periodic structure approximation was used and it was assumed that the structure is illuminated by a plane wave normal to its surface. The simulation result is shown in FIG. 3 which shows close to 340° phase swing for the whole range of slot length variation.

Figure 4:
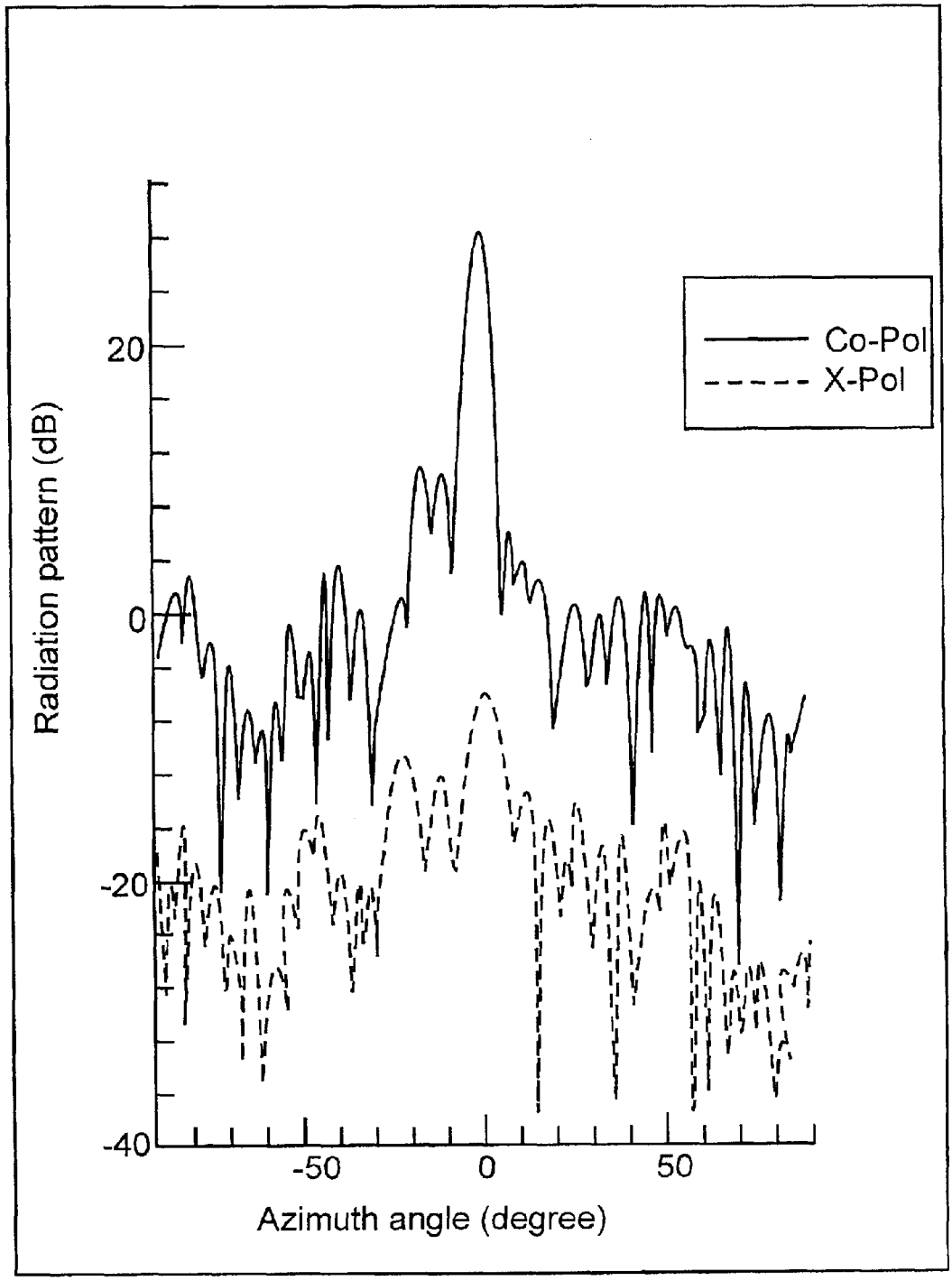
FIG. 4 is a diagram illustrating simulation results of the reflectarray antenna shown in FIGS. 1*a* and 1*b;*

The radiation pattern was measured in the frequency band of 24 GHz to 26.5 GHz. The maximum gain of 28.65 dB was observed which results in 38% radiation efficiency. A typical plot of H-plane radiation pattern for both co-polarization and cross polarization is shown in FIG. 4. The E-plane radiation pattern is very similar to the H-plane radiation pattern with slightly lower side lobes.

Figure 5:
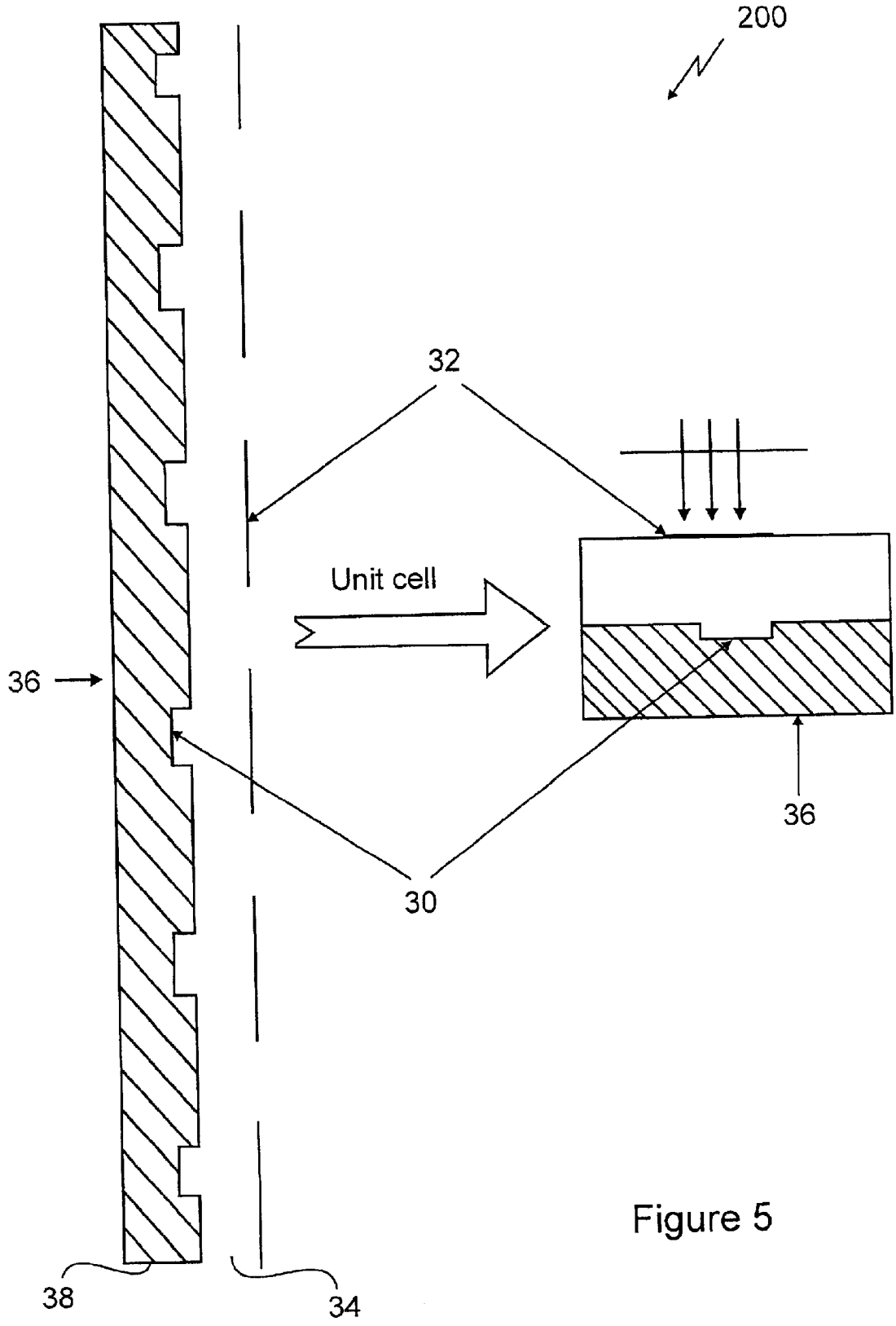
FIG. 5 is a simplified diagram illustrating a cross-sectional view of another embodiment of a reflectarray antenna according to the invention.

Referring to FIG. 5 a schematic view of an embodiment 200 of a reflectarray antenna according to the invention is shown. The difference between this configuration and the previous one is the presence of a ground plane 36 and a second substrate layer 38 having a different permittivity than substrate layer 34, which prevents leakage of power into lower half space.

Figure 6:
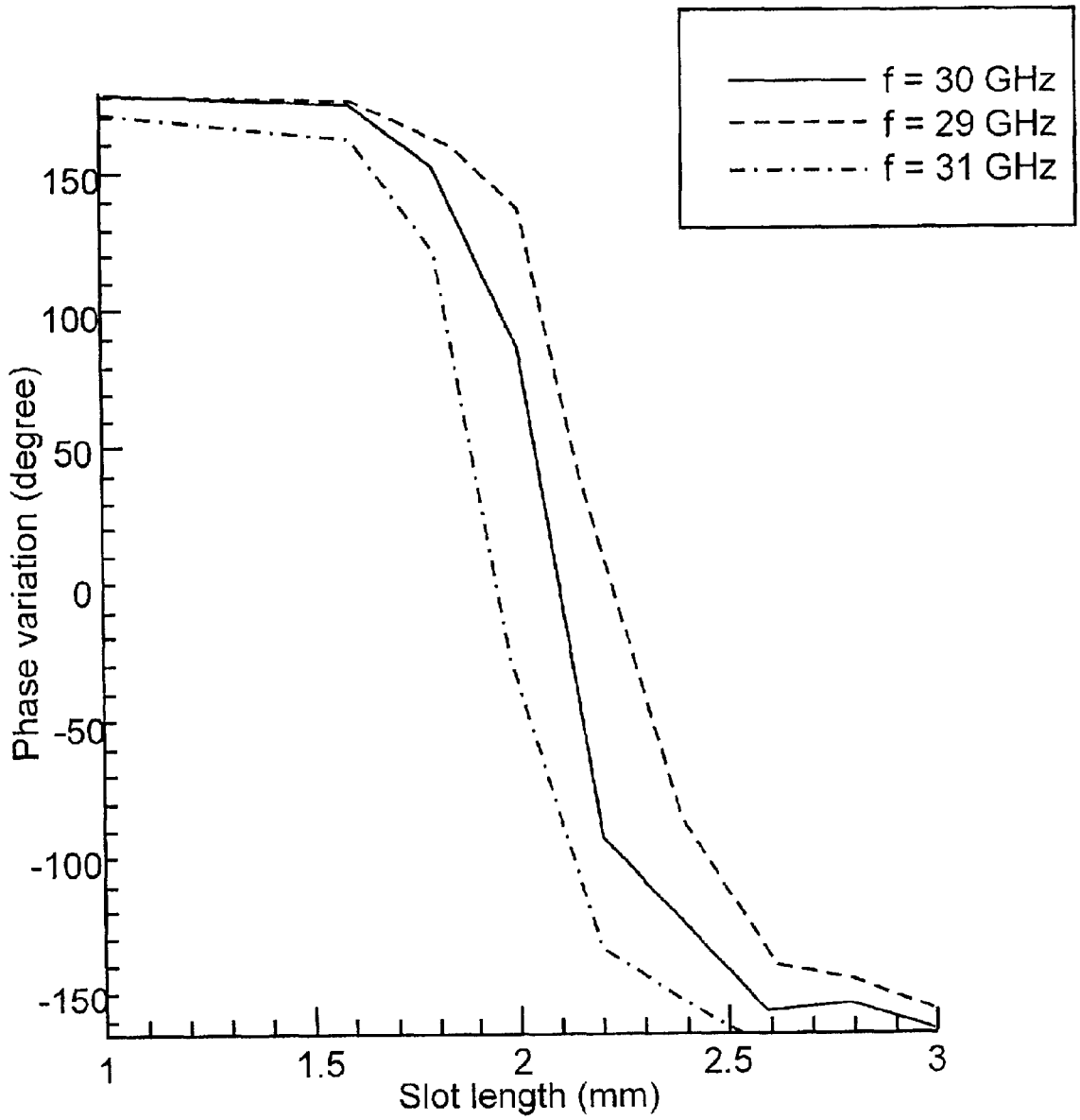
FIG. 6 is a diagram illustrating simulation results of the reflectarray antenna shown in FIG. 5.

HFSS was used to design an antenna based on this configuration that operates at 30 GHz. The phase variation ($\phi$) is implemented by changing the slot length. The substrate thickness for the upper and lower substrates was set at 0.020" and 0.010", respectively. The design comprises 31×31 patches with the fixed dimensions of 3.2 mm ×2 mm, the unit-cell size was 5 mm×5 mm, and slot width was ds=0.2 mm. The simulated phase variation versus slot size for three different frequencies is shown in FIG. 6, showing that a larger phase shift is realized compared to the configuration described in the previous section leading to an improved phase efficiency for the reflectarray 200.

Figure 7:
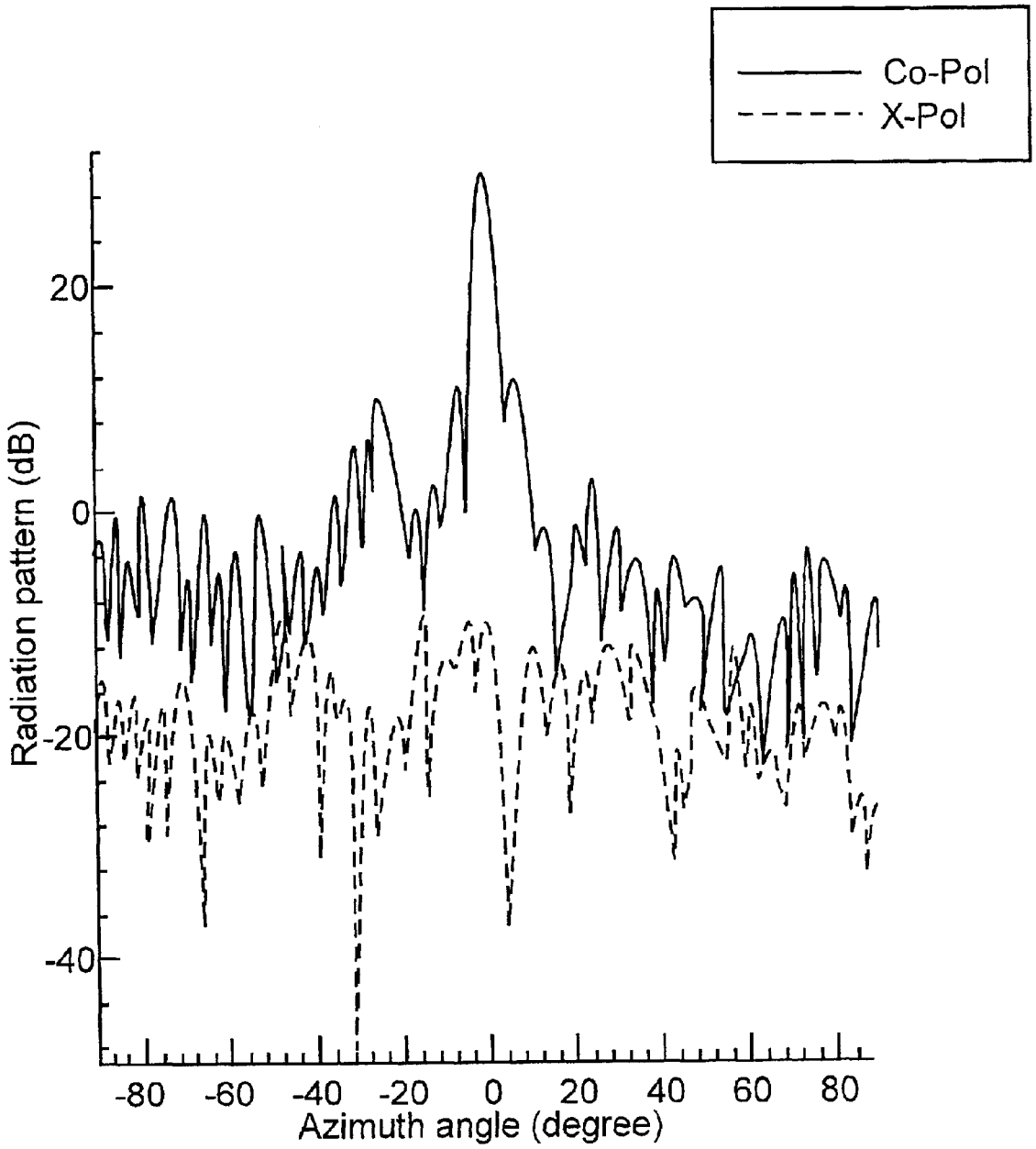
FIG. 7 is a diagram illustrating simulation results of the reflectarray antenna shown in FIG. 5.

The radiation pattern was measured in the frequency band of 28 GHz–31 GHz. A maximum gain of 29 dB with an efficiency close to 43% occurred at 30 GHz. A typical plot of the H-plane pattern for both co-polarization and cross-polarization for F/D=0.9 is shown in FIG. 7. The E-plane pattern is similar to the H-plane.

Figure 8:
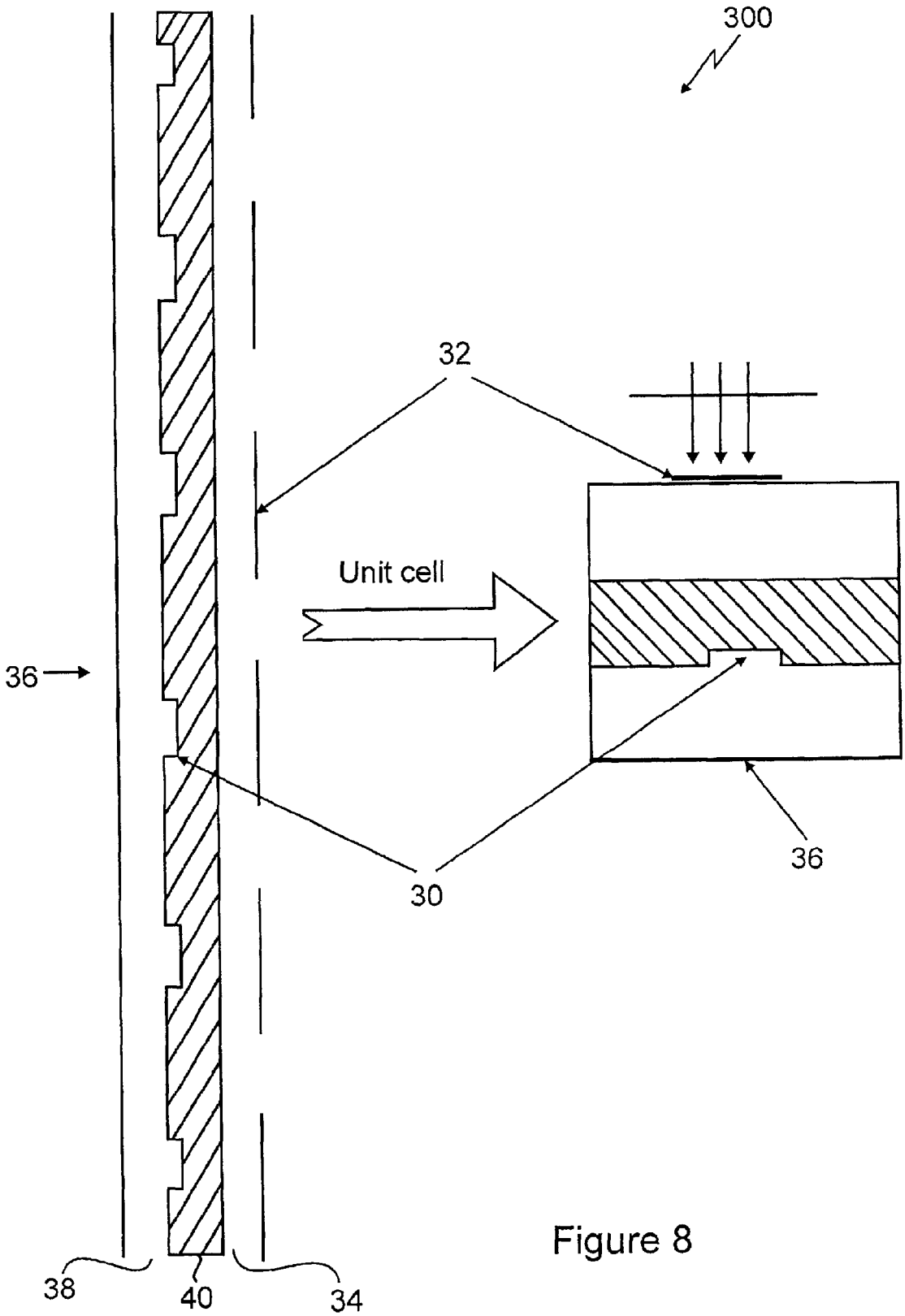
FIG. 8 is a simplified diagram illustrating a cross-sectional view of a preferred embodiment of a reflectarray antenna according to the invention.

Referring to FIG. 8 a schematic view of another, preferred, embodiment 300 of a reflectarray antenna according to the invention is shown. The difference between this configuration and the previous one 200 is the presence of an additional substrate layer 40 between the dissimilar size slots 30 and the substrate layer 34. The substrate layer 40 has a different permittivity than the substrate layers 34 and 38. The additional layer 40 improves the bandwidth and radiation pattern.

Figure 9:
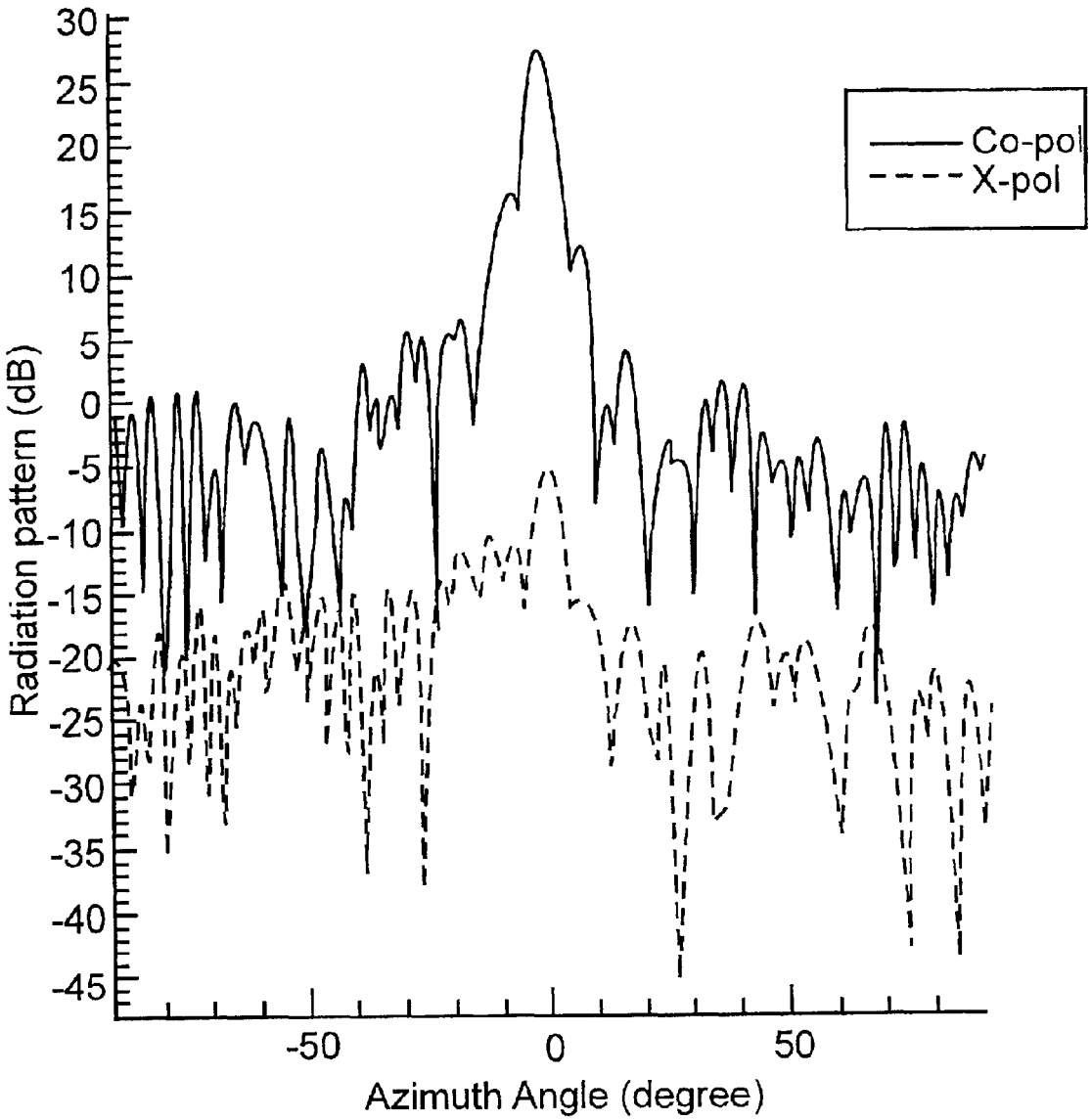
FIG. 9 is a diagram illustrating simulation results of the reflectarray antenna shown in FIG. 8.

The antenna was designed based on this configuration to operate at 30 GHz. The phase variation ($\phi$) is implemented by changing the slot length. The curve for phase variation versus the slot length is similar to FIG. 6 except the slope for this configuration is smoother. The substrate thicknesses for the upper, middle and lower substrates were set at 0.020", 0.025" and 0.08", with permittivity of 2.2, 10.2 and 1 respectively. The design comprised 31×31 patches with the fixed dimensions of 3.2 mm ×2.8 mm, the unit -cell size was 5 mm×5 mm, and slot width was ds=0.2 mm. The radiation pattern was measured in the frequency band of 28 GHz –31 GHz. A gain of 30.5 dB occurred at 30 GHz, which translates into 53% efficiency. A typical plot of the H plane pattern for both co-polarization and cross-polarization for F/D=0.9 is shown in FIG. 9.

The bandwidth of a reflectarray is limited primarily by phase errors that tend to increase as the signal frequency is shifted away from the design frequency and as a result of a nonlinear dependence of the phase shift on the slot size. The slope of the phase versus slot length curve is a measure of the bandwidth of the reflectarray since a curve with a smaller slope leads to less phase error when the electrical size of the element changes as the frequency is shifted away from the design value.

Figure 10:
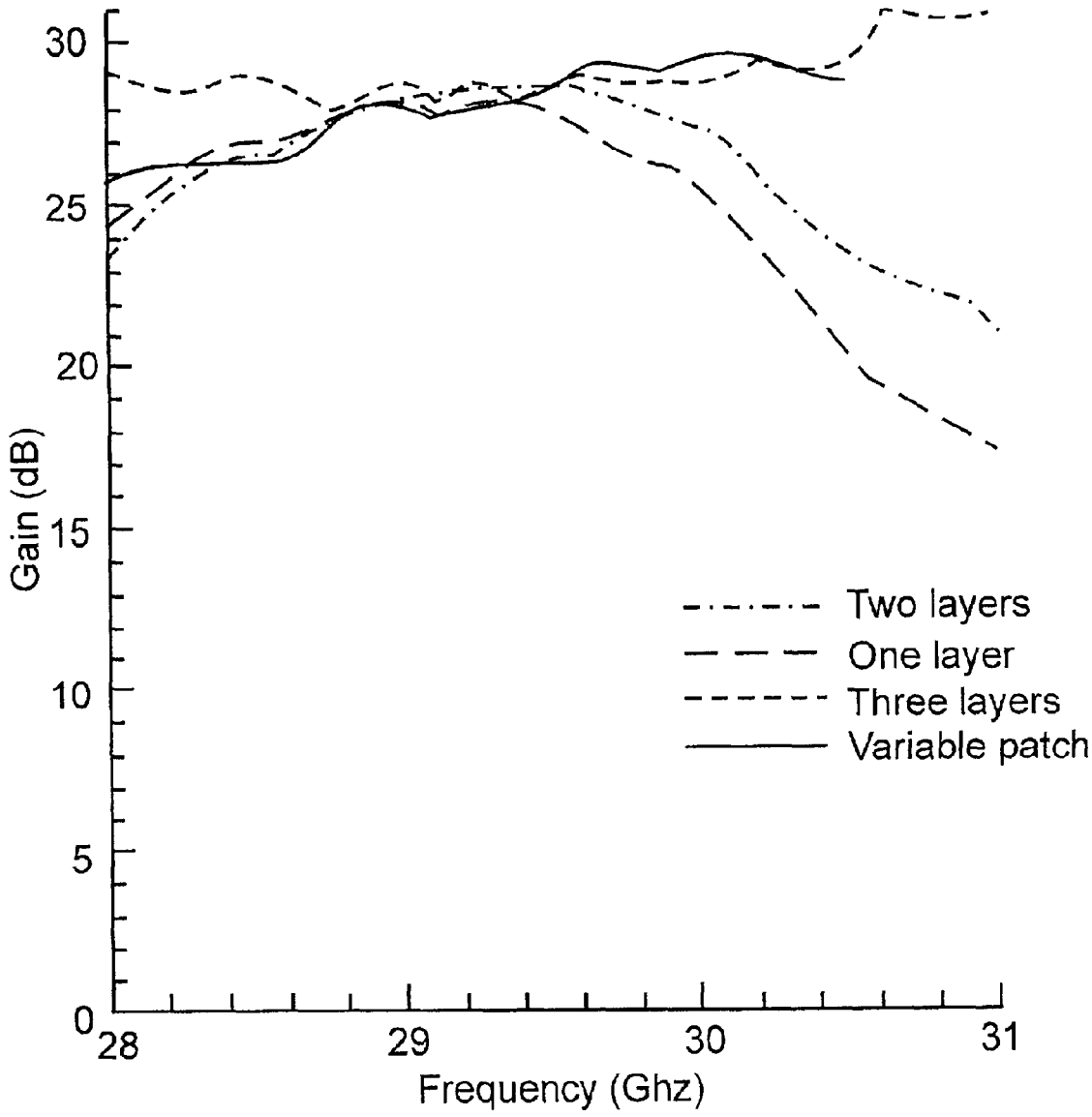
FIG. 10 is a diagram illustrating simulation results of the reflectarray antenna shown in FIG. 8.

FIG. 10 shows reflectarray gain versus frequency for the one, two and three layers configuration with variable slot sizes on the ground plane, and also for a single layer reflectarray composed of patches of variable size. As is shown, the bandwidth for the three-layer reflectarray with variable slot sizes in the ground plane is wider than the other reflectarrays including the reflectarray with variable patches. The bandwidth of double reflectarray of variable slots also shows some improvement over its single layer counterpart.

The area of beam scanning has received enormous interest recently. The demand for antennas capable of high-speed beam scanning and multi-function operation has been on the rise in such areas as modern radar, mobile and satellite communication, and radio astronomy.

Nowadays an intense effort is underway to reduce the cost and increase the power handling capability for commercial applications especially in millimeter-wave (MMW) band. Photo-induced plasma excited in high resistivity semiconductor medium is a promising solution for inexpensive beam steering in the MMW band.

In the following an optical approach based on photo-induced plasma in a semiconductor is disclosed. According to the invention phase shift of the individual micro-strips is modified by shining an appropriate optical image onto each individual element, thereby altering the radiation characteristics of the reflectarray. This approach is highly advantageous for dynamic beam scanning and beam shaping.

Figure 11:
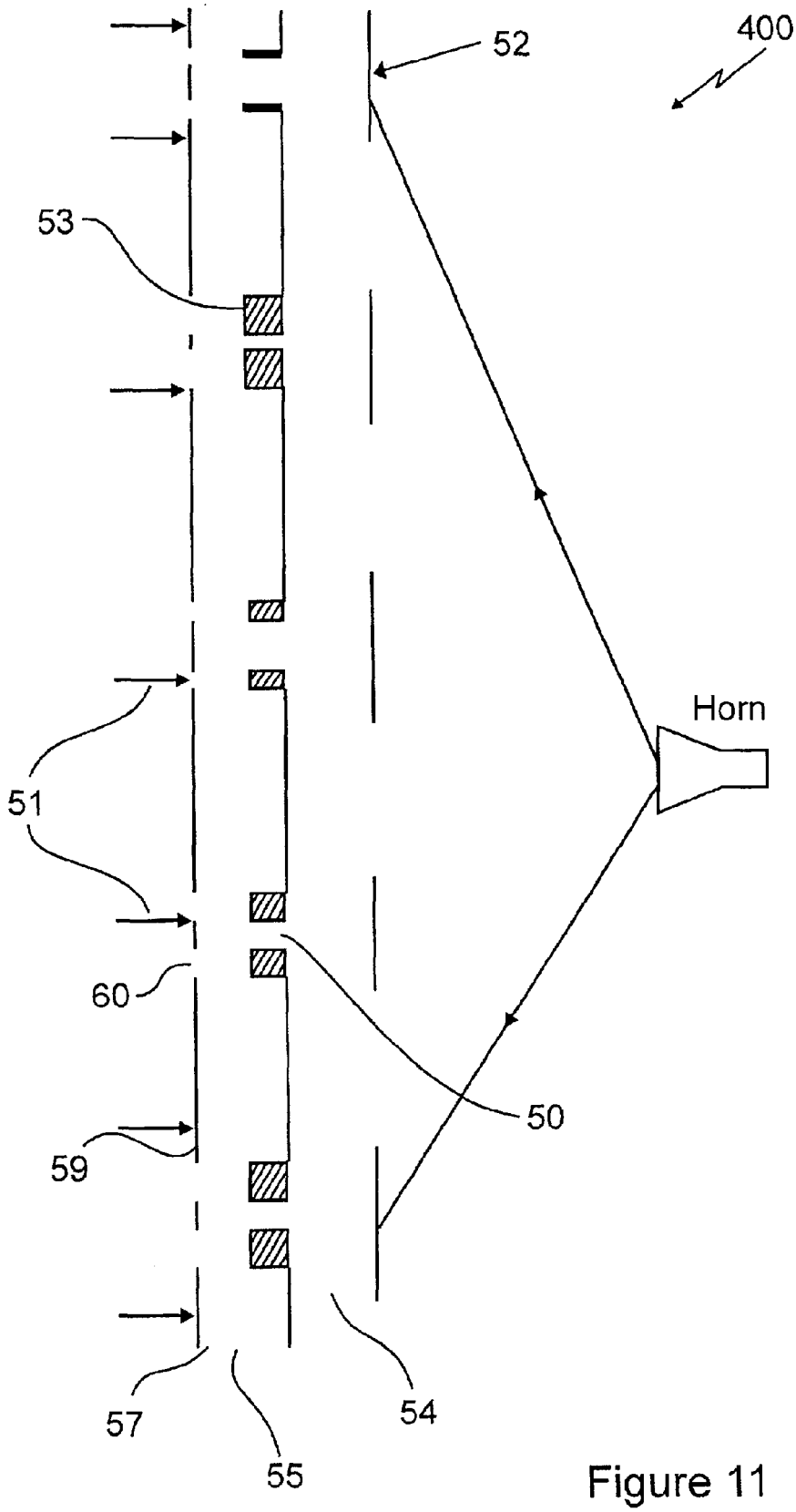
FIG. 11 is a simplified diagram illustrating a cross-sectional view of a reflectarray antenna in accordance with an aspect of to the invention providing optically controlled phase shift of radiating elements.
Figure 12:
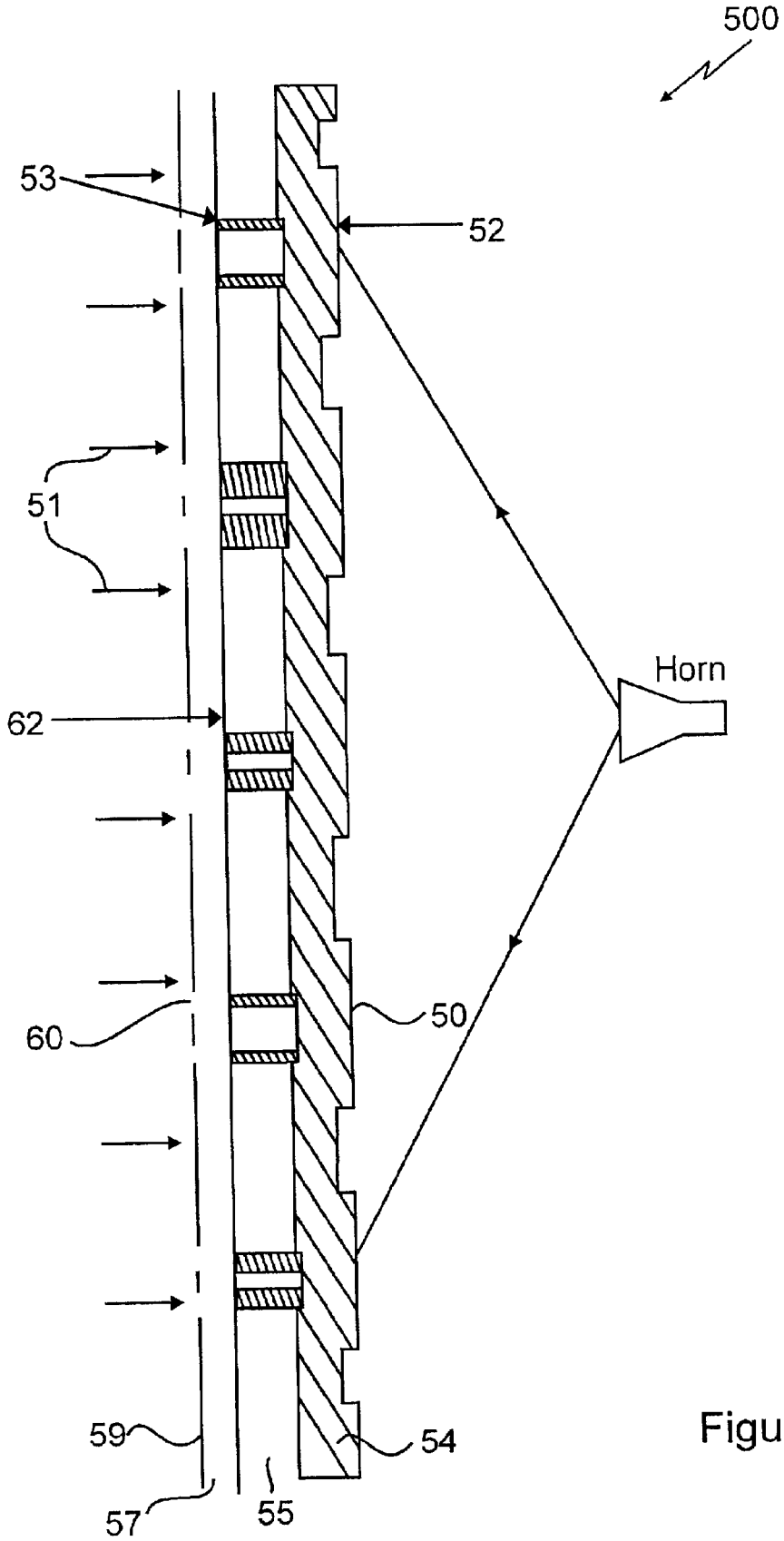
FIG. 12 is a simplified diagram illustrating a cross-sectional view of another embodiment of a reflectarray antenna shown in FIG. 11.

Referring to FIGS. 11 and 12 embodiments 400 and 500 of a reflectarray antenna according to the invention are shown. The embodiments 400 and 500 use photo-induced plasma effect to induce a phase shift in the radiating elements. Considering that incident photons have energies greater than a semiconductor band-gap energy, illuminating light 51 at the surface of the semiconductor layer 55 is absorbed. This leads to creation of electron-hole pairs increasing the conductivity in the plasma 53, resulting in an effect comparable to the variation of the slot length. The profile of conductivity in the plasma 53 and number of electron-hole pairs is controlled with the optical intensity of the illuminating light 51.

The reflectarray antenna 400 comprises a dielectric substrate layer 54 having an array of micro-strip patches 52 attached its top surface. A semiconductor substrate layer 55 is attached to the bottom surface of the dielectric substrate layer 54. Further, there is a small air gap between semiconductor substrate layer 55 and optical mask 59. The semiconductor substrate layer 55 provides a variable inductive loading acting on the micro-strip patches 52 through photo-induced plasma effect in order to induce a predetermined phase shift in the reflected electromagnetic signal. The optical mask 59 has an array of aperture slots 60 being disposed opposite the radiating elements such that at least one slot is disposed opposite each radiating element. The aperture slots 60 allow illumination of the semiconductor substrate to generate the photo-induced plasma effect at predetermined locations.

In another embodiment 500 according to the invention, shown in FIG. 12, a third optically transparent substrate layer in the form of an air gap is adjacent to the semiconductor substrate layer 55 reflector 62 is interposed between the semiconductor substrate layer 55 and the substrate layer 57. The reflector 62 is optically transparent and reflective at the wavelength of the electromagnetic signal and is, for example, made of an indium-tin-oxide (ITO) film. Of course, the transparent substrate may be formed of other optically transparent material such as suitably selected glass.

Alternatively, other than a reflectarray configuration is implemented having variable dimensioned slots and being other than slot fed such that the variable dimensioned slots perform functions similar to those performed for the reflectarray configuration.

Alternatively, beam scanning is achieved by slot length variation using another method such as, for example, a mechanical slot length variation or a chemical slot length variation. Though the term slot length is used above, variation of slot dimensions for varying loading and thereby changing phase characteristics of reflected or emitted radiation is sufficient however achieved.

Figure 13:
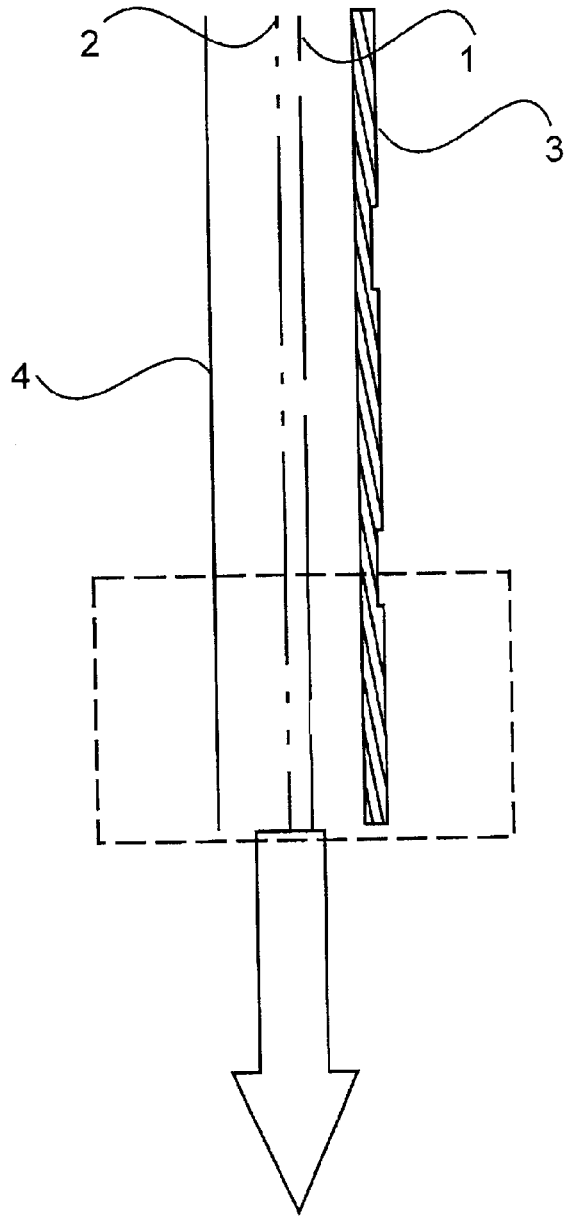
FIG. 13 is a diagram of a unit cell for implementing the invention.
Figure 13:
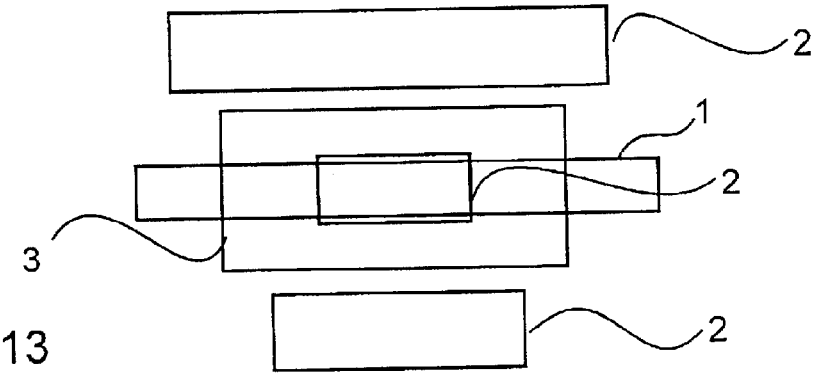

Referring to FIG. 13, an antenna is shown comprising a two-layer reflectarray with identical size patches on a top layer thereof and slots of dissimilar length and slots of identical length on a bottom layer thereof. On the middle layer there are two sets of slots 1 and 2 overlapping each other. The first set of slots 1 are slots with identical sizes and the second set of slots are slots of dissimilar length. There is other than an air gap between these two sets of slots. To scan a beam in this antenna on the layer two, different sets of slots for each angle has been designed and located within a column. For example in FIG. 13, there are three slots in each unit cell of the second slots 2 for collimating the beam at −30, 0 and +30 degrees depending on the specific set of slots that are set beneath the slots of uniform size. The separation between the slots within a same unit cell is 1 mm. Therefore, upward or downward mechanical movement of the second layer relative to the first layer by ±1 mm, result in three different beams with peaks at −30°, 0° and +30°. In accordance with this design, the width of the first slots 1 is 0.2mm and the width of second slots 2 is a little bit larger in order to avoid alignment error due to inaccurate mechanical movement of the sets of slots with respect to each other.

A prototype was made based on the above principle and 0.020" dielectric substrates of $\epsilon_r$=3.0 were used for layers one and two. The patch size is 1.8 mm×3.2 mm. The size of identical slots was 0.2 mm×3.4 mm. The width of slots of dissimilar size was set at 0.5 mm. A reflectarray antenna based on this concept is shown in FIG. 14.

Figure 14:
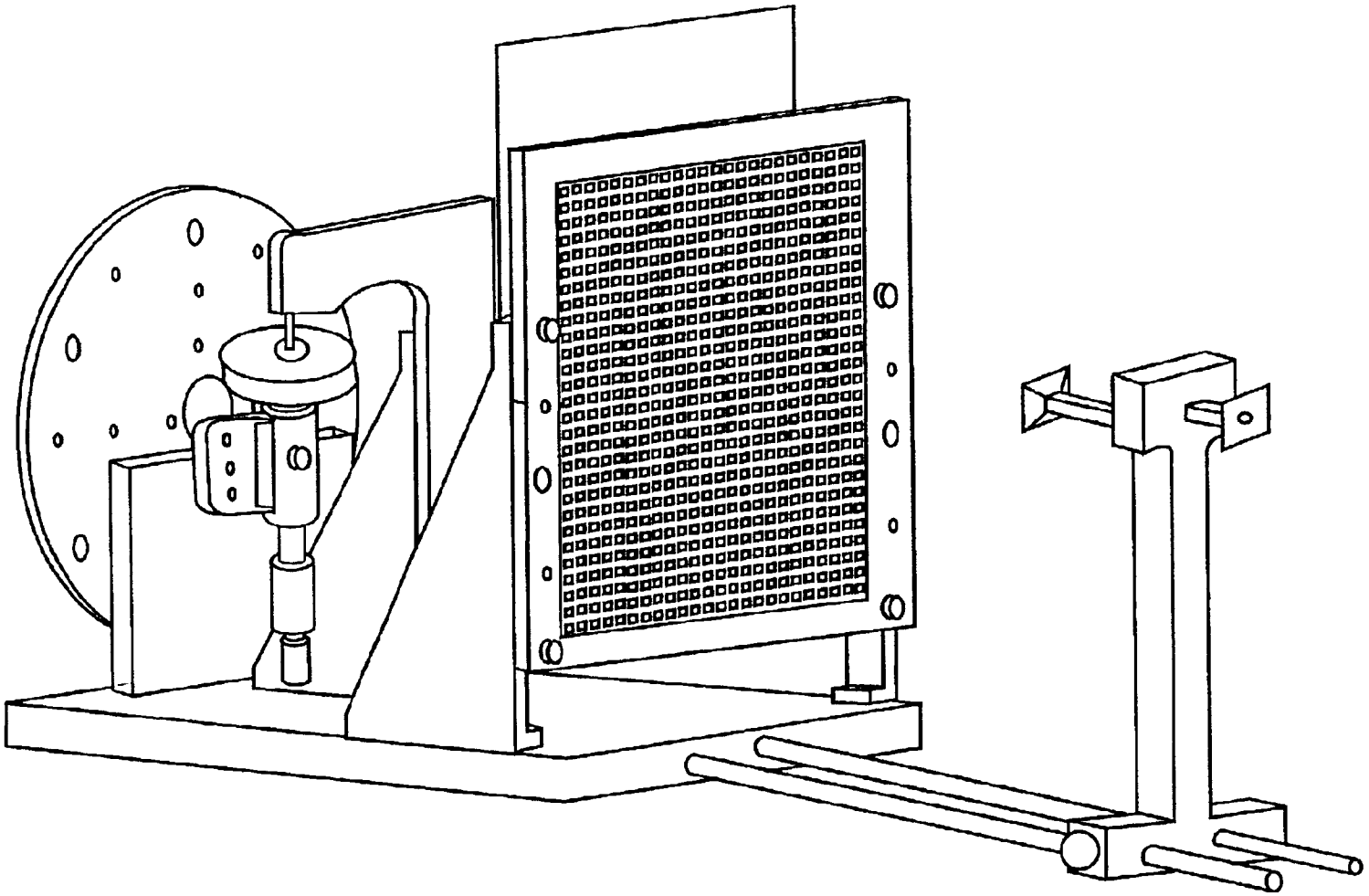
FIG. 14 is a computer generated diagram of a prototype antenna according to the invention; and, FIG. 15 is a graphical representation of a performance of the prototype antenna.
Figure 15:
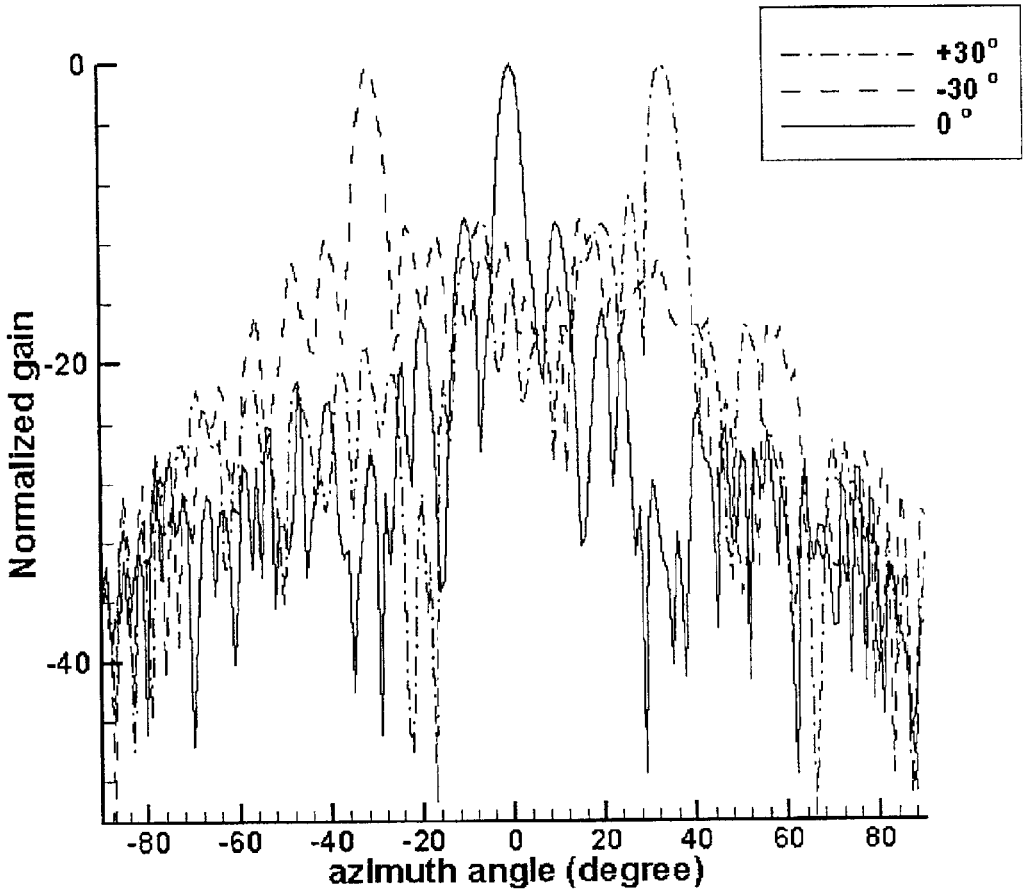

In FIG. 15 is shown the normalized radiation pattern for the antenna of FIG. 14 at 30 GHz. By moving the layer up and down, the beam is switchable between +30°, 0° and −30°.

It should be noted that variation of slot shape and dimensions are carried out while the antenna is operating as a radiating element and not to imprint slots of permanent dimensions on the antenna.

Numerous other embodiments of the invention will be apparent to persons skilled in the art without departing from the spirit and scope of the invention as defined in the appended claims.

What is claimed is:

1. An array antenna comprising:

a substrate layer having a top surface and a bottom surface;

an array of radiating elements disposed on the top surface and for radiating one of an emitted and reflected electromagnetic signal; and, an array of slots disposed adjacent the radiating elements, some slots having a variable dimension for providing a variable inductive loading acting on a radiating element of the array of radiating elements.

2. An array antenna as defined in claim 1, wherein the slots are formed on the bottom surface of the substrate.

3. An array antenna as defined in claim 1, wherein the slots are integral with the substrate.

4. An array antenna as defined in claim 3, wherein the variable dimension is a length of the slot.

5. An array antenna as defined in claim 1, wherein a variation in the dimension of a slot is achieved mechanically.

6. An array antenna as defined in claim 1, wherein a variation in the dimension of a slot is achieved chemically.

7. An antenna as defined in claim 1, wherein the substrate layer comprises a semiconductor substrate layer adjacent the bottom surface, the semiconductor substrate layer having slots formed of a material for providing a variable inductive loading acting on the radiating elements though photo-induced plasma effect generated by selective illumination thereof.

8. An antenna as defined in claim 7, comprising a reflector adjacent the semiconductor substrate layer and opposite the array of radiating elements, the reflector being optically transparent and being reflective at the wavelength of the electromagnetic signal.

9. An antenna as defined in claim 8, wherein the reflector comprises an indium-tin-oxide film.

10. An antenna as defined in claim 7, wherein the radiating elements are microstrip patches.

11. An antenna as defined in claim 8, wherein the slots are disposed opposite the radiating elements such that at least one slot is disposed opposite each radiating element.

12. An antenna as defined in claim 10, wherein the width of the slots is approximately 1/20 of the wavelength of the electromagnetic signal.

13. An antenna as defined in claim 12, wherein one slot is disposed opposite each radiating element.

14. An antenna as defined in claim 13, wherein all slots have a substantially same physical length absent plasma induced effects.

15. An antenna as defined in claim 13, wherein the slots have a different length depending on the location of the slot.

16. A reflectarray antenna as defiled in claim 15, wherein the slots of different lengths are disposed in a lattice configuration.

17. An antenna comprising:

a dielectric substrate layer having a top surface and a bottom surface, an array of radiating elements disposed on the top surface and forming an array of radiating elements, the radiating elements for radiating one of an emitted and reflected electromagnetic signal; and, a bottom surface layer attached to the bottom surface of the dielectric substrate layer, the bottom surface layer having an array of slots, the slots having a variable dimension for providing a variable inductive loading acting on the radiating elements in order to induce a predetermined phase shift in the radiated electromagnetic signal radiating from each radiating element.

18. An antenna as defined in claim 17, comprising a ground plane attached to the bottom surface layer, the ground plane including a second substrate layer of different permittivity than the permittivity of fee dielectric substrate layer.

19. An antenna as defined in claim 18, comprising a third substrate layer interposed between the bottom surface layer and the dielectric substrate layer, the third substrate layer having a different permittivity than the dielectric substrate layer and the second substrate layer.

20. An antenna as defined in claim 17, wherein the radiating elements are microstrip patches.

21. An antenna as defined in claim 20, wherein the slots have a dissimilar length.

22. An antenna as defined in claim 21, wherein the slots are disposed opposite the radiating elements such that a slot is disposed opposite each radiating element.

23. An antenna as defined in claim 22, wherein the width of the slots is approximately 1/20 of the wavelength of the electromagnetic signal.

24. An antenna as defined in claim 22, wherein the slots of variable length are disposed in a lattice configuration.

25. A method for controlling a phase shift of an incoming electromagnetic signal in an antenna comprising:

providing an array antenna having a plurality of radiating elements other than slot fed radiating element and having a plurality of slots for inductively loading the radiating elements from the array of radiating elements; and, adjusting the phase shift of the electromagnetic signal by varying the dimension of some of the plurality of slots.

26. A method according to claim 25, wherein the antenna is reflectarray antenna.

27. A method according to claim 26, wherein the dimension of some slots is dynamically varied during operation of the antenna.

28. A method according to claim 26, wherein the dimension of the slots is varied mechanically.

29. A method according to claim 26, wherein the dimension of the slots is varied chemically.

30. A method according to claim 26, wherein the dimension of the slots is varied optically.

31. A method according to claim 30, wherein slot comprise semiconductor material for providing a variable inductive loading acting on the radiating elements through photo-induced plasma effect.

32. A method according to claim 31, comprising adjusting the phase shift of the radiating elements by illuminating the slots with a predetermined optical intensity for controllably generating a photo-induced plasma effect.

33. A method for controlling a phase shift in an antenna as defined in claim 32, wherein all dots are illuminated with a substantially same optical intensity.

34. A method for controlling a phase shift in an antenna as defined in claim 33, wherein the optical intensity is changed during operation of the antenna.

35. A method for controlling a phase shift in an antenna as defined in claim 32, wherein the slots are illuminated with a different optical intensity depending on the location of the slots.

36. A method for controlling a phase shift in an antenna as defined in claim 35, when the optical intensity is changed during operation of the antenna.

37. A method according to claim 25, wherein th antenna is a radiating antenna other than a reflectarray.

38. A method according to claim 37, wherein the dimension of some slots is dynamically varied during operation of the antenna.

39. A method according to claim 37, wherein the dimension of the slots is varied mechanically.

40. A method according to claim 37, wherein the dimension of the slots is varied chemically.

41. A method according to claim 37, wherein the dimension of the slots is varied optically.

42. A method according to claim 41, wherein slots comprise semiconductor material for providing a variable inductive loading acting on the radiating elements through photo-induced plasma effect.

43. A method according to claim 42, comprising adjusting the phase shift of the radiating element by illuminating with a predetermined optical intensity the slots for controllably generating a photo-induced plasma effect.

44. A method for controlling a phase shift in an antenna as defined in claim 43, wherein all slots are illuminated with a substantially same optical intensity.

45. A method for controlling a phase shift in an antenna as defined in claim 44, wherein the optical intensity is changed during operation of the antenna.

46. A method for controlling a phase shift in an antenna as defined in claim 43, wherein the slots are illuminated with a different optical intensity depending on the location of the slots.

47. A method for controlling a phase shift in an antenna as defined in claim 46, wherein the optical intensity is changed during operation of the antenna.

* * * * *